US008426098B2

(12) United States Patent
Nakamura et al.

(10) Patent No.: US 8,426,098 B2
(45) Date of Patent: Apr. 23, 2013

(54) IMAGE PRINT AND IMAGE FORMING METHOD

(75) Inventors: Mitsutoshi Nakamura, Aichi (JP); Shigenori Kouno, Tokyo (JP); Kazuyoshi Goan, Kanagawa (JP); Kouichi Sugama, Tokyo (JP); Ito Koga, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 235 days.

(21) Appl. No.: 13/050,087

(22) Filed: Mar. 17, 2011

(65) Prior Publication Data

US 2011/0236652 A1 Sep. 29, 2011

(30) Foreign Application Priority Data

Mar. 23, 2010 (JP) ..... 2010-066269

(51) Int. Cl.
*G03G 13/08* (2006.01)

(52) U.S. Cl.
USPC ..... 430/123.4; 430/124.23

(58) Field of Classification Search ..... 430/123.4, 430/124.23
See application file for complete search history.

(56) References Cited

U.S. PATENT DOCUMENTS

| | | | | |
|---|---|---|---|---|
| 2003/0119943 | A1* | 6/2003 | Tucker et al. | 523/160 |
| 2008/0096116 | A1* | 4/2008 | Utsumi et al. | 430/48 |
| 2011/0136059 | A1* | 6/2011 | Yang | 430/137.14 |

FOREIGN PATENT DOCUMENTS

| | | |
|---|---|---|
| JP | 05-297626 | 11/1993 |
| JP | 06-242627 | 9/1994 |
| JP | 09-197858 | 7/1997 |
| JP | 11-160905 | 6/1999 |
| JP | 2000-250249 | 9/2000 |
| JP | 2004-101648 | 4/2004 |

* cited by examiner

*Primary Examiner* — Hoa V Le
(74) *Attorney, Agent, or Firm* — Lucas & Mercanti, LLP

(57) ABSTRACT

Disclosed is an image print which has a toner-holding layer on an image-supporting substrate in which the toner-holding layer holds a toner image formed by toner particles, wherein the toner-holding layer is composed of a hydrogel having a water content of 10% by mass or more and not more than 90% by mass.

8 Claims, 3 Drawing Sheets

IMAGE PRINT AND IMAGE FORMING METHOD

This application is based on Japanese Patent Application No. 2010-66269 filed on Mar. 23, 2010, in Japanese Patent Office, the entire content of which is hereby incorporated by reference.

TECHNICAL FIELD

The present invention relates to an image print having a toner-holding layer holding a toner image on an image-supporting substrate and an image forming method for forming this.

BACKGROUND

In an electophotographic image forming method in which an image is formed by electrostatically developing toner image, a heat-pressure roll and flash light are employed for a method of fixing toner on an image supporting material, hitherto (refer to, for example, Patent Document 1 and Patent Document 2).

However these methods require a plenty of energy, because is fixed on an image supporting material by deforming and adhering toner, and it is not preferable in an energy saving view point.

A method of fixing by only pressure without heating is proposed as energy saving fixing method, (Refer to, for example, Patent Document 3). A method in which hollows are provided on a surface of an image supporting material, and toner particles are adhered electrostatically in the hollows is further proposed (for example, Patent Document 4).

However, there is a problem that sufficient adhesion to an image supporting material is not obtained and an expected image quality is not obtained by a method using only pressure. Further, there is a problem that releasing toner particles from the hollows is not avoided and stain due to released toner occurs depending on methods providing hollows.

Further, there is a problem that high quality image is not obtained because there are an image portion having toner and non-image portion having no toner, whereby a minute step is formed between an image portion and a non-image portion in the image, by image forming methods disclosed in Patent Documents 1 to 4.

A method is proposed to dissolve the problem of step between an image portion and a non-image portion, in which toner is allowed to exist in non-image portion (for example, Patent Document 5). The other method is proposed, in which a resin layer is provided on a surface of an image supporting material, and the toner and the resin layer of the image supporting material are molt by heat and pressure in fixing process, whereby fixing is conducted by that toner is fixedly adhere to the surface of the image supporting material (for example, Patent Document 6).

However, by a method disclosed in Patent Document 5, gaps are formed between toner and toner, the formed image print has high white turbidity and sufficient profound color is not obtained. Further, sufficient image quality is not obtained by the method of melting the resin layer and toner disclosed in Patent Document 6. This described above, hitherto, there is no image forming method to obtain high quality image simultaneously to attain energy saving.

PRIOR ART DOCUMENT

Patent Document

Patent Document 1: JP-A 2004-101648
Patent Document 2: JP-A H05-297626

Patent Document 3: JP-A H06-242627
Patent Document 4: JP-A 2000-250249
Patent Document 5: JP-A H09-197858
Patent Document 6: JP-A H11-160905

SUMMARY OF THE INVENTION

Problem to be Dissolved by the Invention

The object is to provide an image print which has a high image quality, an expected precision, and high strength in image such that there is no change in image due to external forte, and an image forming method for forming the image print.

Another object of the invention is to provide an image forming method of forming an image print which has a high image quality, an expected precision, and high strength in image such that there is no change in image due to external forte simultaneously to attain energy saving.

The image print of the invention comprises a toner-holding layer on an image-supporting substrate, wherein a toner image formed by toner particles is held by the toner-holding layer, wherein the toner-holding layer is composed of a hydrogel having water content of 10% by mass or more and not more than 90% by mass.

It is preferable in the image print of the invention, the hydrogel composing the toner-holding layer has a factor of shrinkage of not more than 10% by volume with respect to an initial stage when water content is reduced 10% by mass from an initial stage.

The image forming method of the invention comprises steps of;

allowing the image-supporting substrate to cavy a toner image formed by toner particles on its surface, and superposing the toner-holding layer on the image-supporting substrate so that the toner-holding layer holds the toner image, whereby an image print is formed, wherein the toner-holding layer is composed of a hydrogel having water content 10% to 90% by mass.

The image forming method of the invention comprises steps of;

allowing a toner-holding layer to hold a toner image formed by toner particles, and superposing an image-supporting substrate on the toner-holding layer holding the toner image, whereby an image print is formed, wherein the toner-holding layer is composed of a hydrogel having water content 10% to 90% by mass.

The image forming method of the invention comprises steps of;

superposing a toner-holding layer on an image-supporting substrate, and allowing the toner-holding layer superposed on the image-supporting substrate to hold a toner image formed by toner particles, wherein the toner-holding layer is composed of a hydrogel having water content 10% to 90% by mass.

The image forming method of the invention is characterized by obtaining an image print using toner particles separated horn an image print formed by the image forming method described above.

The image forming method of the invention is characterized by obtaining an image print using an image-supporting substrate separated from the image print formed by the image forming method.

The image forming method of the invention comprises steps of;

allowing an image-supporting substrate to carry a toner image formed by toner particles, and superposing a toner-holding layer composed of a hydrogel having water content 10% to 90% by mass, wherein at least one of the toner particles, the toner-holding layer and the image-supporting substrate for forming the toner image, is separated from an image print formed by an image forming method described above.

The image forming method of the invention comprises steps of;

allowing a toner-holding layer composed of a hydrogel having water content 10% to 90% by mass to hold a toner image formed by toner particles, and superposing the toner-holding layer holding the toner image on an image-supporting substrate, wherein at least one of the toner particles, the toner-holding layer and the image-supporting substrate for forming the toner image, is separated fern an image print formed by an image forming method described above.

The image forming method of the invention comprises steps of superposing a toner-holding layer composed of a hydrogel having water content 10% to 90% by mass on an image-supporting substrate, and allowing the toner-holding layer superposed on the image-supporting substrate to hold a toner image formed by toner particles, wherein at least one of the toner particles, the toner-holding layer and the image-supporting substrate for forming the toner image, is separated from an image print formed by an image forming method described above.

According to the image print of the invention a toner image is held in a toner-holding layer, and the surface is in a high uniformity state, there is no difference height of an image portion fern non-image portion, therefore, high image quality is obtained. Further, a toner-holding layer is composed of a hydrogel having specific low water content, and when the toner-holding layer holds the toner image, turbulence of a toner image is inhibited, therefore, an image having expected precision is displayed, and thither, the obtained image has high strength in image without occurring change in image due to external force since toner particles composing the image print are held by an action of liquid crosslinking sufficient.

According to the image print of the invention a toner image can be fixed on an image-supporting substrate without applying heat, and energy saving is realized. Further, a toner image is held in the toner-holding layer, and therefore the surface is in a high uniformity state, there is no difference height of an image portion from non-image portion, therefore, high image quality is obtained. Further, since a toner-holding layer is composed of a hydrogel having specific low water content, when the toner-holding layer holds the toner image, turbulence of a toner image is inhibited, an image having expected precision is displayed, and further, the obtained image has high strength in image without occurring change in image due to external force since toner particles composing the image print are held by an action of liquid crosslinking sufficient.

Further, a method of reusing toner particles and/or a toner-holding layer and/or an image-supporting substrate separated from the image print obtained by the image forming method according to the invention realize large energy saving as a whole.

BRIEF DESCRIPTION OF DRAWINGS

FIG. 1*b* illustrates a state that an image fixing sheet is superposed, and FIG. 1*c* illustrates a state that a toner image is carried and fixed on an image-supporting substrate.

FIG. 2*b* illustrates a state that a toner image is held in a toner-holding layer of an image fixing sheet; and FIG. 2*c* illustrates a state that a toner image is carried and fixed on an image-supporting substrate.

FIG. 3*b* illustrates a state that a toner image is held in a toner-holding layer of an image-supporting substrate.

DESCRIPTION OF THE PREFERRED EMBODIMENTS

An image print and an image forming method of the invention are described in detail.

The First Embodiment

The first embodiment practicing the image forming method according to the invention is characterized in that after allowing the image-supporting substrate to carry a toner image formed by toner particles on its surface, the toner-holding layer holding the toner image is superposed to form an image print, and a hydrogel having water content 10% to 90% by mass is used as a toner-holding layer.

Figure 1A:
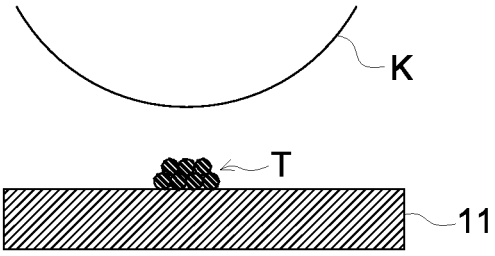
FIGS. 1*a* to 1*c* are schematic view for explaining the first embodiment of an image forming method relating to the invention, and, FIG. 1*a* illustrates a state that a toner image is formed on an image-supporting substrate.
Figure 1B:
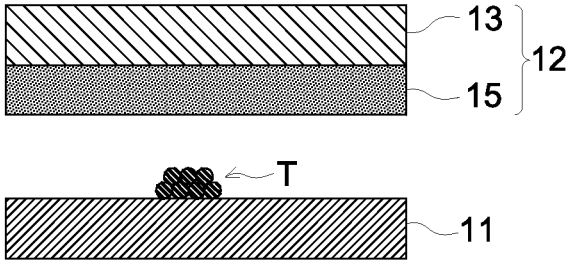
Figure 1C:
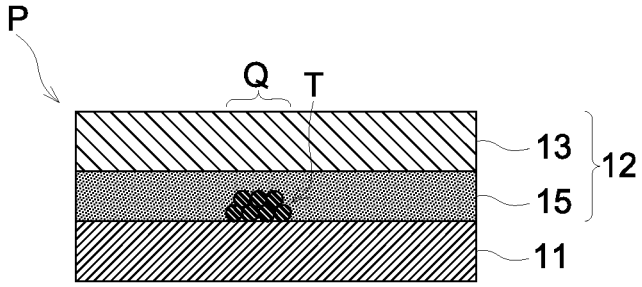

An image print P is obtained in an image forming method of the invention concretely by the following way as shown in FIG. 1 (*a*)-(*c*), toner image T formed electrostatically with toner particles on photoreceptor K is transferred onto image-supporting substrate 11; image fixing sheet 12 composed of toner-holding layer 15 laminated on one surface of surface protecting layer 13 is superposed on image-supporting substrate 11 carrying toner image T so as to bring image-supporting substrate 11 into contact with toner-holding layer 15, whereby the toner image T is subjected to busying process in the toner holding layer 15 and toner image T is held by toner-holding layer 15; and consequently toner image T is fixed on image-supporting substrate 11 to form image portion Q.

Heating is not required for the fixing process in this instance, however, it may be heated at low temperature, for example, around 60-80° C. for obtaining an image print having high quality.

The external force given to bury the toner particles of the toner image T may be in the range of $1.00\times10^3$ to $1.00\times10^8$ Pa, varying in accordance with mechanical strength of toner particles composing toner image T, and kind or water content of hydrogel composing toner-holding layer 15.

External force to bury toner particles toner-holding layer 15 includes static force given by, for example, an adequate transfer device, pressure force to press image fixing sheet 12 on image-supporting substrate 11, and a combination of these.

It is preferable to satisfy the following Formula (I), provided that A represents the particle shape factor of the toner particles used for forming toner image T and B represents the particle shape factor of toner particles composing toner image T held by toner-holding layer in the image forming method of the invention;

$$1.0 = B/A = 0.9 \quad \text{Formula (I)}$$

wherein the particle shape factor of the toner particles is represented by:

(minimum particle diameter of the projection of a particle)/(maximum particle diameter of the projection of the particle).

When the value of (B/A) representing the extent of the change in the particle shape factor of the toner particles before the forming the toner image T and after held by toner-holding layer 15 is within the range satisfying above Formula (1), an image print P having a high quality image can be obtained. When, the value of (B/A) representing the extent of the change in the particle shape factor is less than 0.9, a large amount of energy is needed to obtain an image print, which is not preferable in view of a large environmental load.

Specifically, the particle shape factor A of the toner particles used in the forming toner image T is determined by:

removing a toner image T electrostatically formed on a photoreceptor K;

obtaining an image of the toner particles at a magnification of 2000 times using a scanning electron microscope (SEM) JSM-7401F (produced by JEOL Ltd.);

loading the image of the toner particles in a LUZEX IMAGE PROCESSOR (produced by NIRECO Corp.); and measuring the maximum particle diameter and the minimum particle diameter of each particle to calculate the particle shape factor by dividing the minimum particle diameter with the maximum particle diameter, followed by averaging the particle shape factors of 100 toner particles to obtain the particle shape factor.

The particle shape factor A of the toner parches after subjected to the toner image holding process is, specifically, determined by:

obtaining an image of the toner particles in a cross-sectional slice of an image print P at a magnification of 2000 times using a transmission election microscope (TEM) JEM-1400F (produced by JEOL Ltd.);

loading the image of the toner particles in a LUZEX LMAGE PROCESSOR (produced by NIRECO Corp.); and measuring the maximum particle diameter and the minimum particle diameter of each particle to calculate the particle shape factor by dividing the minimum particle diameter with the maximum particle diameter, followed by averaging the particle shape factors of 100 toner particles to obtain the particle shape factor.

The particle shape factor A of the toner particles for forming toner image T is preferably 0.40 to 1.00 in practice, and more preferably 0.60 to 1.00. the particle shape factor of toner particles B after held by toner-holding layer 15 is preferably 0.40 to 1.00 in practice, 0.40 to 1.00, and more preferably 0.60 to 1.00.

The condition represented by Formula (I) can be attained by, for example, by employing toner particles having 10% deformation strength of 1 to 100 MPa (hereafter, referred to hard type toner particles).

The 10% deformation strength is a value measured by employing Micro Compression Testing Machine MCT-W201 (product by Shimadzu Corp.) in compression test mode.

The image forming method of the invention is not restricted to use the hard type toner particles, toner particles having elasticity and/or shape memory property with restoring degree of 70% or more (hereafter referred also to the elastic toner particles) can be employed.

Toner particles for reuse showing similar behavior to toner particles at an initial stage can be obtained by employing the elastic toner particles having such restoring degree, as separated from toner-holding layer 15 and is subjected to restore processing according to necessity, in case that toner-holding layer 15 holds deformed toner particles, as described later.

Restoring degree of the elastic toner particles can be measured in load-no load test mode by Micro Compression Testing Machine DUH-W201S (product by Shimadzu Corp.).

According to the image print of the invention as described above toner image T can be fixed on an image-supporting substrate 11 without applying heat, and energy saving is realized. Further, toner image T is held in the toner-holding layer, and therefore the surface is in a high uniformity state, there is no difference height of an image portion Q from non-image portion, therefore, high image quality is obtained. Further, since a toner-holding layer 15 is composed of a hydrogel having specific low water content, when the toner-holding layer holds the toner image, turbulence of toner image T is inhibited, an image having expected precision is displayed, and further, the obtained image has high strength in image without occurring change in image due to external force since toner particles composing the image print P are held by an action of liquid crosslinking sufficient.

Image Print

The image print of the invention P is composed of that, as shown in FIG. 1 (*c*), toner-holding layer 15 is superposed on image-supporting substrate 11, a toner image formed by toner particles T is held in toner-holding layer 15, and surface protecting layer 13 can be provided on toner-holding layer 15 according to necessity.

Image-Supporting Substrate

An appropriate material can be used as an image supporting substrate 11 used for the specified image forming method, for example, standard paper including from thin paper to thick paper, high-quality paper, printing paper which is coated such as art paper and coat paper, commercially available Japanese paper and post mid paper, polypropylene synthetic paper, a polyethylene terephthalate (PET) film, a polyethylenenaphthalate (PEN) film, a polyimide film and cloth. Of these, preferable are those having high strength which do not lose the property even after a number of repeated recycling for example, 10 times or more. Preferable examples of an image supporting substrate 11 which is subjected to a number of recycling include: standard paper having stiffness, art paper, a polyethylene terephthalate (PET) film, a polyethylenenaphthalate (PEN) film and a polyimide film.

(Toner-Holding Layer)

Toner-holding layer 15 is composed of a hydrogel having water content of 10 to 90% by mass of, preferably 30 to 50% by mass, (hereafter, referred to specific hydrogel).

When the water content of hydrogel composing toner-holding layer 15 is within a range as described above, an image print P having a high quality image with small quantity of energy, and further, turbulence of toner image T is inhibited when toner-holding layer 15 is allowed to hold toner image T, an image having expected precision is displayed, and further, the obtained the has high strength in image without occurring change in image due to external force since toner particles composing the image print are held by an action of liquid crosslinking sufficient. On the other side, when water content of the hydrogel composing the toner-holding layer 15 is insufficient, high strength in image is not obtained because power holding toner particles is weak by insufficient amount of water required for liquid crosslinking, and change in image due to external force easily occurs. When water content of the hydrogel composing the toner-holding layer 15 is in excess, large turbulence of toner image T occurs in the process of holding toner image T to hold in toner-holding layer 15 and as the result, an image having expected precision is not obtained.

Water content of the hydrogel is a ratio of water contained in the hydrogel at room temperature (25° C.). Practically 1 gram of hydrogel (mass at mom temperature) is heated gradually from room temperature to 160° C. by a moisture meter MA100 (produced by SARTORIUS KK), and mass (g) is measured at a temperature at which change of mass is not observed, and it is calculated by the following Formula.

Water content of the hydrogel (% by mass)={(1−mass at a temperature at which change of mass is not observed (g))/1}×100

It is preferable that the specific hydrogel a factor of shrinkage of not more than 10% by volume with respect to the initial stage when water content is reduced 10% by mass from the initial stage.

Change in image is inhibited by employing the specific hydrogel even when water content changes due to environmental change.

It is preferable that the specific hydrogel does not display fluidity when external force is not applied, and displays fluidity when external force is applied. Concretely, for example, the hydrogel having thixotropic property, which is gel in a normal state and changes into sol when external force is applied, can be used.

It is preferable that the specific hydrogel has fluidity such that the change of the particle shape factor is inhibited at minimum when the toner particles are allowed to bury by an external force, (hereafter, referred to specific fluidity).

Toner image T formed on photoreceptor K by adhering toner particles electrostatically is allowed to bury toner-holding layer 15 at a state that electrostatic charge of each toner particles is maintained by employing hydrogel having such specific fluidity.

Toner-holding layer 15 composed of the specific hydrogel can be formed, practically, by (1) adjusting water content of the hydrogel material preliminarily adequately and forming the layer using it, or, (2) allowing a gel layer gel layer formed by a hydrogel material without adjusting water content to absorb water by standing in an adequate humidity environment.

As a material for forming the toner holding layer 15, a material which is immiscible with the toner resin composing toner particles (hereafter, referred also to toner resin) may be appropriately chosen, and the material having high compatibility with toner particles is preferable.

As a hydrogel material for forming the toner-holding layer 15, a material which is recyclable as a material for forming a toner-holding layer used for forming another image forming after subjected to the aboveinentioned separation process is preferable.

The hydrogel can be manufactured by methods of polymerizing monomers forming crosslinking structure via heating or irradiating an actinic my such as UV ray, micro wave and electron beam; dissolving water soluble crosslinking polymer in an aqueous solvent at high temperature and then cooling it adding a crosslinking agent to aqueous solution of a polymer, and the like.

Examples of the hydrogel material constituting toner holding layer 15 include a resin, an elastomer or a rubber of such as an acrylic compound and a urethane compound; and their aqueous emulsion, aqueous polymer, and a gel or a sol with an organic solvent of the above compounds.

Practical examples of an acrylic resin include copolymers of 2-ethylhexyl acrylate and n-butyl acrylate; as well as methyl acrylate, ethyl acrylate, methyl methacrylate, acrylic acid, methacrylic acid, itaconic acid, an acrylamide derivative, hydroxyethyl acrylate and glycidyl acrylate.

As a urethane resin, polyurethane prepolymers obtained by reacting a polyol with a polyisocyanate are cited. Examples of a polyol include: 1,2-polybutadiene polyol, 1,4-polybutadiene polyol, poly(pentadiene butadiene)polyol, poly(butadiene styrene)polyol and poly(butadiene acrylonitrile)polyol. Examples of a polyisocyanate include diphenylmethane diisocyanate, tolylene diisocyanate, naphthalene diisocyanate, polymethylene polyphenyl isocyanate, xylylene diisocyanate, lysine diisocyanate, hexamethylene diisocyanate, isophorone diisocyanate and methylene bis(cyclohexyl isocyanate).

Examples of a water soluble polymer include naturally occurring polymer polysaccharides such as xanthan gum, carrageenan, pullulan, furcelleran, curdlan, gelatin and collagen; naturally occurring low-molecular polysaccharides such as sodium alginate and calcium alginate; a polyacrylic acid; sodium polyacrylate; and polyvinyl alcohol.

Examples of an aqueous solvent include methyl alcohol, ethyl alcohol, ethylene glycol, propylene glycol, polyethylene glycol and glycerin.

Preferable example of the hydrogel material is an acrylic resin. Preferable example of the acrylic resin includes a polyacrylic acid, a polyacrylic acid ester, and a copolymer containing acrylic acid or a acrylic acid ester, and the like. Those having polybutadiene are also preferable. The other example is one which is obtained by mixing polyvinyl alcohol with other polymer and subjected to actinic ray such as UV ray.

The hydrogel preferably has an adherent property.

The thickness of the toner holding layer 15 is determined in relation to the thickness of the toner image T to be held in the toner-holding layer, and the thickness is, for example, 1 to 500 μm, preferably 3 to 300 nm and more preferably 8 to 200 nm.

The toner holding layer can be prepared by providing the hydrogel preliminarily formed gel material on the image substrate, or coating hydrogel raw material on the image substrate then forming hydrogel via heating or irradiating UV rays or the like.

(Surface Protecting Layer)

Surface protecting layer 13, which is provided when required for example, for storage ability or writing ability with a pencil, is transparent.

Examples of a material forming surface protecting layer 13 include a sheet of polyethylene terephthalate (PET), polyethylene naphthalate (PEN), polypropylene (PP), and polystyrene (PS); organic solvent soluble resins such as a polystyrene resin, an acrylic resin and a polyester resin; and cured material of surface protecting layer forming composition such as a photo curing agent, a heat curing agent and a moisture curing agent. As the surface protecting layer forming composition, the same composition as one for forming toner-holding layer 15 can be used.

Thickness of the surface protecting layer 13 is preferably 10 to 200 μm, more preferably 25 to 100 μm.

Toner Particles

The toner particles used in the image forming method of the present invention contain at least a resin, and, according to the necessity, a colorant a charge controlling agent, magnetic particles, a release agent. The aggregate of such toner particles is referred to as a "toner" in the following description. Toner particles before use will be described, below.

(Production Method of Toner Particles)

The method of producing such toner particles is not specifically limited, and any of a pulverizing method, an emulsion dispersion method, a suspension polymerization method, a dispersion polymerization method, an emulsion polymerization method, an emulsion polymerization aggregation method, and other known methods is applicable.

Toner Resin

When toner particles are manufactured, for example, by a pulverization method or an emulsion dispersion method the toner resin include varieties of well known resins, for example, vinyl resins such as a styrene resin, a (meth)acrylic resin, a styrene-(meth)acrylic copolymer resin and an olefin resin, a polyester resin, a polyamide resin, a polycarbonate resin, a polyether resin, a polyvinyl acetate resin, a polysulfone resin, an epoxy resin, a polyurethane resin and an urea resin. These resins may be used alone or in combination of two or more.

When toner particles are produced by, for example, a suspension polymerization method, a dispersion polymerization method, an emulsion polymerization method or an emulsion polymerization agglomeration method, examples of a polymerizable monomer to obtain a resin exhibiting elasticity or a shape memory effect include: styrene and styrene derivatives such as styrene, o-methylstyrene, m-methylstyrene, p-methylstyrene, a-methyl styrene, p-chlorostyrene, 3,4-dichlorostyme, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecyl styrene; methacrylate derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate; lauryl methacrylate, phenyl methacrylate, diethylaminoethyl methacrylate and dimethylaminoethyl methacrylate; acrylate derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; olefins such as ethylene, propylene and isobutylene; vinyl halogenides such as vinyl chloride, vinylidene chloride, vinyl bromide, vinyl fluoride and vinylidene fluoride; vinyl esters such as vinyl propionate, vinyl acetate and vinyl benzoate; vinyl ethers such as vinyl methyl ether and vinyl ethyl ether, vinyl ketones such as vinyl methyl ketone, vinyl ethyl ketone and vinyl hexyl ketone; N-vinyl compounds such as N-vinylcarbazole, N-vinyl indole and N-vinyl pyrrolidone; and vinyl compounds such as vinyl naphthalene and vinylpyridine; vinyl monomers of acryl derivatives or a methacryl derivatives such as acrylonitrile, methacrylonitrile and acrylamide. These vinyl monomers may be used alone or in combination of two or more.

As a polymerizable monomer, one having an ionic dissociable group is preferably used in combination. Polymerizable monomers having an ionic dissociable group include those having a substituent such as a carboxyl group, a sulfonic acid group, and a phosphoric acid group, as a constituting group, and examples of which include: acrylic acid, methacrylic acid, maleic acid, itaconic acid, cinnamic acid, fumaric acid, maleic acid mono-alkyl ester, itaconic acid mono-alkyl ester, styrene sulfonic acid, allylsulfo succinic acid, 2-acrylamide-2-methylpropane sulfonic acid, acidphosphoxyethyl methacrylate and 3-chloro-2-acidphosphoxypropyl methacrylate.

Further, a binder resin having a cross linked structure can be obtained by using a multi-functional vinyl compounds as a polymerizable monomer, for example, divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate and neopentylglycol diacrylate.

The elastic toner particles can be obtained by using a material exhibiting elasticity and/or a shape memory effect.

Toner resin exhibiting shape memory property includes polymer material such as an elastomer having shape memory property.

As an elastomer which has shape memory effect, for example, a cross-linked shape memory elastomer formed via a physical or chemical cross-linking process, and a networked shape memory elastomer in which a network polymer and a phase transformation polymer are mixed may be cited. Examples of a specific elastomer exhibiting a shape memory effect include:

cross-linked shape memory polymers obtained by polymerizing monomers such as norbornane, styrene, butadiene, isoprene, methylmethacrylate, butylacrylate, ethylene, propylene, acrylic acid, isofluorone diisocyanate and oxypropylene glycol, using a cross-linking agent or a chain extender such as peroxy ketal, hindered phenol, benzoyl peroxide, 1,4-butanediol and ethylene glycol, cross-linked shape memory polymers obtains d by being subjected to a chain extension process after polymerization such as polynorbornane, polyurethane, polyisoprene, polyethylene and a styrene butadiene copolymer; and networked shape memory polymer obtained by mixing networked polymers such as an epoxy resin, a phenol resin, an acrylic resin, polyester and a melanin resin, and phase transformation polymers such as polycaprolactone, polyvinylchloride, polystyrene, polybutylene succinate, polyethylene terephthalate, a polybutylene terephthalate and polyphenylene sulfide.

The elastic toner particles can be obtained by using a material exhibiting elasticity such as an elastomer having rubber-like elasticity.

Examples of an elastomer having rubber elasticity include rubbers such as a natural rubber and a synthetic rubber, and a thermoplastic elastomer having an alloy structure of a resin and a rubber, which is fluidic at a higher temperature, but plastic deformation is prevented at a normal temperature, and provides a reinforcing effect to a rubber.

Examples of an elastomer having rubber elasticity include: a natural rubber containing cis-polyisoprene as a main component; a natural gutta-percha containing trans-polyisoprene as a main component; acrylic rubbers obtained by addition polymerizing or copolymerizing monomers such as acrylic acid, butylacrylate, 1,3-butadiene, 2-chloro-1,3-butadiene, acrylonitrile, isoprene, chloroprene, styrene, a-methylstyrene, p-chlorostyrene, isobutylene, hexamethyl siloxane, tetrafluoroethylene, isocyanate, oxypropylene glycol, epichlorohydrin, ethylene and propylene; synthetic rubbers such as an acrylonitrile-butadiene rubber, an isoprene rubber, a urethane rubber, an ethylene-propylene rubber, an epichlorohydrin rubber, a chloroprene rubber, a silicone rubber, a styrene-butadiene rubber, a butadiene rubber, a fluororubber and a polyisobutylene rubber, a methacrylic acid-butadiene copolymer, an acrylic acid-butadiene copolymer, a methylmethacrylate-methyl butadiene copolymer; a styrene-butadiene copolymer, a styrene-isoprene copolymer; a styrene-ethylene butylene copolymer, a styrene-ethylene propylene copolymer, a styrene-isobutylene copolymer; a methyl vinyl ketone-butadiene copolymer; an olefin-thermoplastic elastomer (TPO, TPV); a vinyl chloride-thermoplastic elastomer (TPVC); an amide-thermoplastic elastomer, an ester-thermoplastic elastomer; and an urethane-thermoplastic elastomer.

Colorant

In the case when the toner contains a colorant; varieties of organic or inorganic pigments of various kinds and various colors as shown below may be used.

Examples of a black colorant include: carbon black, copper oxide, manganese dioxide, aniline black, active carbon, non-magnetic ferrite, magnetic ferrite and magnetite.

Examples of a yellow colorant include: chrome yellow, zinc yellow, cadmium yellow, yellow iron oxide, mineral fast yellow, nickel titanium yellow, navel orange yellow, Naphthol Yellow S, Hansa Yellow G, Hansa Yellow 10G, Benzidine Yellow G, Benzidine Yellow GR, quinoline yellow lake, Permanent Yellow NCG and Tartrazine lake.

Examples of an orange pigment include: red chrome yellow, molybdenum orange, Permanent Orange GTR, pyrazolone orange, Vulcan Orange, Indanthrene Brilliant Orange RK, Benzidine Orange G and Indanthrene Brilliant Orange G K.

Examples of red pigment include: quinacridone, red iron oxide, cadmium red, minium, mercury sulfide, cadmium, Permanent Red 4R, Lithol Red, pyrazolone red, Watching Red, calcium salt, Lake Red C, Lake Red D, Brilliant Carmine 6B, cosine lake, rhodamine lake B, alizarin lake and Brilliant Carmine 3B.

Examples of a purple pigment include: manganese purple, Fast Violet B, methyl violet lake.

Examples of a blue pigment include: Prussian blue, cobalt blue, alkali blue color lake, Victoria blue lake, metal phthalocyanine blue, non-metal phthalocyanine blue, phthalocyanine-blue partial chlorination, fast sky blue and Indanthrene Blue BC.

Examples of a green pigment include: chrome green, chrome oxide, Pigment Green B, mica light green lake and final yellow green G.

Examples of a white pigment include: zinc white, titanium oxide, antimony white and zinc sulfide.

Examples of an extender pigment include: barite powder, barium carbonate, clay, silica, white carbon, talc, alumina white, etc. are cited.

These pigments may be used alone or in combination of two or more.

The addition amount of a colorant is preferably 0.5 to 20 mass parts, and more preferably 2 to 10 mass parts, in 100 mass parts of a toner resin.

Magnetic Particle

In the case when magnetic particles are contained in the toner particles, for example, magnetite, γ-hematite or varieties of ferrites may be used as magnetic particles. The addition amount of magnetic particles is preferably 10 to 500 mass pans, and more preferably 20 to 200 mass parts, in 100 mass parts of the toner resin.

Charge Control Agent

When a charge control agent is contained in the toner particles, the charge control agent is not specifically limited as far as it is possible to provide a positive or negative charge via triboelectric charging and varieties of known charge control agents are usable. Specifically, examples of a positive charge control agent include: nigrosine dyes such as NIGROSINE BASE EX (produced by Orient Chemical Industries, Ltd.); quaternary ammonium salts such as Quaternary ammonium salt P-51 (produced by Orient Chemical Industries, Ltd.) and COPY CHARGE PX VP435 (produced by HOECHST JAPAN Co., Ltd.); and imidazole compounds such as an alkoxylamine, an alkylamide, a molybdic acid chelate pigment and PLZ 1001 (produced by SHIKOKU CHEMICALS Corp.). Examples of a negative charge control agent include: metal complexes such as BONTRON S-22 (produced by Orient Chemical Industries, Ltd.), BONTRON S-34 (produced by Orient Chemical Industries, Ltd.), BONTRON E-81 (produced by Orient Chemical Industri, Ltd.), BONTRON E-84 (produced by Orient Chemical Industries, Ltd.) and SPILON BLACK TRH (produced by Hodogaya Chemical Co., Ltd.); quaternary ammonium salts such as a thioindigo pigment and COPY CHARGE NX VP434 (produced by HOECHST JAPAN Co., Ltd.); calixarene compounds such as BONTRON E-89 (produced by Orient Chemical Industries, Ltd.); boron-containing compounds such as LR147 (produced by Japan Carlit Co., Ltd.); and fluorine-containing compound such as magnesium fluoride and carbon fluoride.

In addition to the above described materials, other examples of a metal complex used as a negative charge control agent include: compounds having varieties of structures such as a oxycarboxylic acid metal complex, a dicarboxylic acid metal complex, an amino acid metal complex, a diketone metal complex, a diamine metal complex, an azo group-containing benzene-benzene derivative metal complex, and an azo group-containing benzene-naphthalene derivative metal complex.

Thus, the charge ability of the toner can be improved by incorporating a charge control agent in the toner particles.

The addition amount of a colorant is preferably 0.01 to 30 mass parts, and more preferably 0.1 to 10 mass parts, in 100 mass parts of a toner resin.

Release Agent

When a release agent is contained in the toner particles, varieties of known waxes are usable. It is preferable to use polyolefin waxes such as a low molecular weight polypropylene or polypropylene, and an oxidation type polyethylene or polypropylene.

The amount to be added of a release agent is preferably 0.1 to 30 mass parts, and more preferably 1 to 10 mass parts, in 100 mass parts of the toner resin.

Particle Diameter of Toner Particles

The volume median diameter of the toner panicles is preferably 3 to 8 μm. When the volume medial diameter is 3 to 8 μm, an excellent reproducibility of a thin-line and a high quality picture image can be obtained, as well as the consumption of toner particles can be reduced compared with when larger diameter toner particles are used.

The volume median diameter of toner particles is measured and calculated using a measurement device of "COULTER MULTISIZER 3 (produced by BECKMAN COULTER, Inc.) connected with a data processing computer system installed with data processing software "SOFTWARE V3.51" (produced by BECKMAN COULTER, Inc.). Specifically, 0.02 g of the toner is added in 20 ml of a surfactant solution (a surfactant solution prepared, for example, via ten-fold dilution of a neutral detergent containing a surfactant composition with purified water in order to disperse the toner particles), followed by being wetted and then subjected to ultrasonic dispersion for 1 minute to prepare a toner particles dispersion. The toner particles dispersion is injected into a beaker set on the sample stand, containing "ISOTON II" (produced by BECKMAN COULTER, Inc.), using a pipette until the concentration indicated by the measurement device reaches 8%. This concentration makes it possible to obtain reproducible measurement values. Then, a measured particle count number and an aperture diameter are adjusted to 25,000 and 50 μm, respectively, in the measurement device, and a frequency value is calculated by dividing a measurement range of 1 to 30 μm into 256 part. The particle diameter at the 50% point from the higher side of the volume accumulation fraction is designated as the volume median diameter.

Average Circularity of Toner Particles

The average circularity defined by the following Formula (S) of the toner particles described so far is preferably 0.700 to 1.000, and more preferably, of 0.850 to 1.000.

Average circularity=(circumferential length of a circle having the same projective area as that of a particle image)/(circumferential length of the projective particle image) Formula (S)

External Additive

The above described toner particles themselves can constitute the toner according to the invention. However, to improve fluidity, chargeability, and cleaning properties, the toner particles may be added with an external additive, for example, a fluidizer which is so-called a post-treatment agent, or a cleaning aid, to form the toner.

The post-treatment agent includes, for example, inorganic oxide particles such as silica particles, alumina particles, or titanium oxide particles; inorganic-stearate particles such as aluminum stearate particles or zinc stearate particles; or inorganic titanate particles such as strontium titanate or zinc titanate. These can be used alone or in combination of at least 2 types.

These inorganic particles are preferably subjected to surface treatment with a silane coupling agent, a titanium coupling agent, a higher any acid, or silicone oil to enhance heat-resistant storage stability and environmental stability.

The total addition amount of these various external additives is 0.05 to 5 mass parts, preferably 0.1 to 3 mass pans in 100 mass parts of the toner. Further, various appropriate external additives may be used in combination.

Developer

The toner according to the invention may be used as a magnetic or non-magnetic single-component toner or a double-component toner by mixing with carriers. When the toner is used as a single-component developer, magnetic particles of a diameter of 0.1 to 0.5 μm are incorporated in a non-magnetic single-component developer or in a toner, both of which are usable. When the toner is used as a two-component toner, it is possible to use, as a carrier, magnetic particles conventionally known in the art, including metals such as iron, ferrite, or magnetite, as well as alloys of the above metals with metals such as aluminum or lead, but ferrite particles are specifically preferable. Further, it is also possible to use, as the carrier, coated carriers in which the surface of magnetic particles is coated with a coating agent such as a resin; or binder-dispersed carriers composed of magnetic particles dispersed in a binder resin.

According to the image print P the surface of the image print P exhibits a highly homogeneous state because obtained image print P has a toner holding layer 15 and the toner image T is held in the toner holding layer 15 and there is no level difference of image portion Q from non-image portion, whereby the image print P having high quality image can be obtained. Disorder of the toner image T is suppressed when the toner image is held in the toner-holding layer 15 and image having expected accuracy can be obtained, since the toner-holding layer 15 is composed of hydrogel having specific low water content. And further, the obtained image has high image strength without occurring image distortion by external force since toner particles composing the image is held by sufficient force by an action of liquid crosslinking.

(Reuse of Toner Particles)

It is preferable that toner particles are separated an image print P obtained by the image forming method of the invention via a separating process, and the toner containing the separated toner particles (hereafter, referred also to toner for reuse) is reused as an image forming material to obtain another image print. The concrete kinds of image forming methods are not restricted, and it is preferable to be used particularly in the specific image forming method described above.

A reuse system attaining enema saving by repeating the specific image forming method described above and toner particles separation process, alternatively.

It is preferable to satisfy the relation expressed by the following Formula (II), provided that A represents the panicle shape factor of toner particles used for forming the first image print P and B represents the particle shape factor of separated toner panicles horn the first image print P in the recycle system.

$$1.0=C/A=0.9 \quad \text{Formula (II)}$$

When the value of (C/A) representing the extent of the change in the panicle shape factor of the toner particles before and after the separation process is fallen within the range expressed by above relation of (2), the behavior of the toner particles after the separation process may be the same as the behavior of the initial toner particles, and, therefore, the separated toner particles can be used in the abovementioned specified image forming method. When the value of (C/A) representing the extent of the change in the particle shape factor of the toner particles is less than 0.9, the behavior of the toner particles after the separation process may be different from the behavior of the initial toner particles, and, therefore, it is difficult to reuse the separated toner particles in the abovementioned specified image forming method.

Specifically, the particle shape factor C of the toner particles after the separation process is determined by:

obtaining an image of the toner particles at a magnification of 2000 times using a scanning electron microscope (SEM) JSM-7401F (produced by JEOL Ltd.); loading the image of the toner particles in a LUZEX IMAGE PROCESSOR (produced by NIRECO Corp.); and measuring the maximum particle diameter and the minimum particle diameter of each particle to calculate the particle shape factor by dividing the minimum particle diameter with the maximum particle diameter, followed by averaging the particle shape factors of 100 toner particles to obtain the particle shape factor.

The particle shape factor of toner particles C of the toner particles composing the toner for reuse is preferably 0.40 to 1.00, and more preferably 0.60 to 1.00 in practice.

Toner particles for reuse are obtained by immersing toner-holding layer 15 holding a toner image in separation liquid which can dissolve or swell a hydrogel material composing toner-holding layer 15, and, does not dissolve toner particles. Materials to be immersed in the separation liquid are image print P, or, toner-holding layer 15 holding toner image T peeled horn an image-supporting substrate 11.

Further, toner particles for reuse can be obtained by wiping process abrading a layer holding toner image T of toner-holding layer 15 holding toner image T separated horn image-supporting substrate 11 with cloth or the like.

Further, in case that magnetic material is used in the toner particles, toner particles for reuse an be obtained by a method in which toner-holding layer 15 is separated from an image-supporting substrate 11 holding toner image T by applying magnetic force to an image print P from opposite side to a side contacting to toner-holding layer 15 of an image-supporting substrate 11 (lower side in FIG. 1 (*c*)), and then, toner particles is separated from image-supporting substrate 11 by releasing magnetic forth, or a method in which toner-holding layer 15 holding toner image T is separated from image print P, and toner particles are separated from toner-holding layer 15 by applying magnetic force.

Separation Liquid

Separation liquid which dissolves or swells the hydrogel material and does not dissolve the toner particles includes, for example, water, methyl alcohol, ethyl alcohol, ethylene glycol, propylene glycol, polyethylene glycols, glycerin, and a mixture thereof.

The separation liquid may contain a surfactant and the like to enhance the compatibility of toner panicles, the hydrogel material forming the toner-holding layer 15, and image-supporting substrate 11.

Thus, the toner particles and the image supporting substrate 11 which were separated in the state where they were immersed in a separation liquid can be respectively recovered, for example, by using a centrifuge.

The toner particles recovered as described above can be reused in the image forming method of the next cycle, for example, by adding compensating amount of the external additive when the separated toner particles contains the external additive before the separation.

Further, for example, in case that toner particles are produced employing a material having shape memory property as a toner resin and the shape of the toner particles is deformed, toner for reuse is obtained by subjecting to adequate restore treatment to restore the deformed shape on the deformed toner particles as recover and then short external additive is supplied to expected amount.

The amount of the external additive Adhered to separated toner particles can be determined, for example, by using an X ray fluorescence analyzer. Specifically, X ray fluorescence analyzer "XRF-1700" (produced by SHIMADZU Corp.) is usable.

The difference between the enemy to form an image print P(N) formed by using toner particles prepared from raw materials by granulation and the energy to form an image print P(R) formed by using the recycled toner particles recovered as above substantially corresponds to the energy difference obtained by subtracting the subtotal of the energy required in the separation process and the energy to add the insufficient external additive (hereafter, referred to as a recycling energy) from the energy required to granulate the toner particles from raw materials (hereafter, referred to as an initial production energy). A large energy saving effect can be obtained since the recycling energy is extremely smaller than the initial production energy.

(Reuse of Toner-Holding Layer)

It is preferable in the reuse system that a hydrogel material composing toner-holding layer 15 is separated from one image print P via a separating process, and a new toner-holding layer (hereafter, a toner-holding layer for reuse) is formed by reusing the separate hydrogel material (hereafter, referred also to separated hydrogel material) as an image forming material, and is used in the specific image forming method described above.

Further, toner-holding layer 15 are separated via a separating process, and a toner-holding layer for reuse is formed by reusing the separated toner-holding layer as an image forming material, and is used in the specific image forming method described above.

A reuse system attaining energy saving by repeating the specific image forming method described above and toner-holding layer separation process, alternatively.

The toner-holding layer for reuse is obtained by dissolving used toner-holding layer in separation liquid dissolving the hydrogel material composing toner-holding layer 15 and not dissolving other component, obtaining separated hydrogel material by removing separation liquid of hydrogel material, and forming a layer using recovered hydrogel material. Materials to be immersed in the separation liquid are toner-holding layer 15 holding toner image T peeled from image print P, or image-supporting substrate 11.

Further, it is obtained by immersing to swell in separation liquid which can swell the hydrogel material forming toner-holding layer 15, removing other components other than hydrogel material and separation liquid, and standing it.

Further, toner-holding layer for reuse cantle obtained by wiping process abrading a layer holding toner image T of toner-holding layer 15 holding toner image T separated from image-supporting substrate 11 with cloth or the like.

Further, toner-holding layer for reuse can be obtained by removing toner particles by applying magnetic force to toner-holding layer 15 holding toner image T, the toner-holding layer in a solid state from which removed toner particles have been removed is molt, and a layer is formed employing this. Or toner-holding layer for reuse can be obtained by standing the toner-holding layer in a solid state from which removed toner particles have been removed.

(Reuse of Image-Supporting Substrate)

Further it is preferable that the image-supporting substrate is separated from one image print P via a separating process, and the separated image-supporting substrate (hereafter, also referred to an image-supporting substrate for reuse) is reused as an image forming material to obtain an image print, in this reuse system. In particular, it is preferable to be used the specific image forming method described above. It is preferable that an image-supporting substrate is reused ten times or more in the view point of energy saving.

A reuse system attaining energy saving by repeating the specific image forming method described above and image-supporting substrate separation process, alternatively.

The image-supporting substrate for reuse is obtained by separating image fixing sheet 12 holding toner image T from mage directly pint P.

It is also obtained by immersing image print P in separation liquid dissolving or swelling a hydrogel material and not dissolving image-supporting substrate.

The difference between the energy to form an image pint P(N) formed by using image-supporting substrate from raw materials by granulation and the energy to form an image print P(R) formed by using the recycled image-supporting substrate recovered as above substantially corresponds to the energy difference obtained by subtracting the subtotal of the energy required in the separation process from the energy required to manufacture the image-supporting substrate from raw materials.

A large energy saving effect can be obtained since the energy required in separation process is extremely smaller than the initial production energy.

The Second Embodiment

Figure 2A:
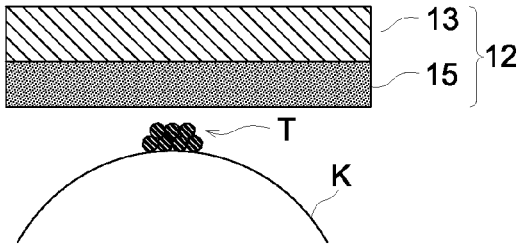
FIGS. 2*a* to 2*c* are schematic view for explaining the second embodiment of an image forming method relating to the invention, and, FIG. 2*a* illustrates a state that a toner image is formed on a photoreceptor.
Figure 2B:
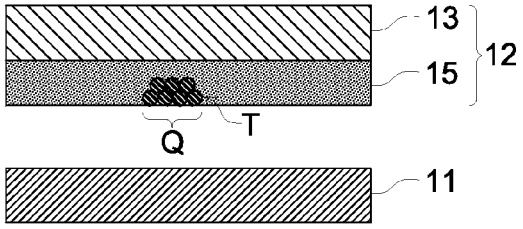
Figure 2C:
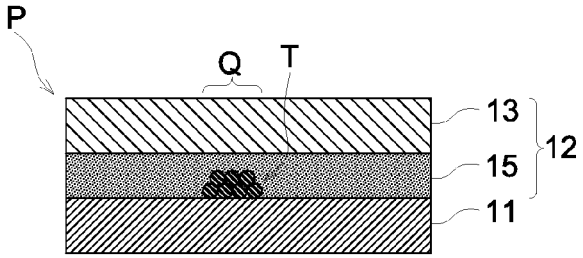

The second embodiment practicing the image forming method of the invention is a method same as the first embodiment excepted that, for example, toner image T is embedded in toner-holding layer 15 in the image fixing sheet 12 via external force so that toner particles are held, by employing image fixing sheet 12 composed of toner-holding layer 15 formed on surface protecting layer 13, and then an image fixing sheet 12 holding toner image T is superposed so that toner-holding layer 15 is brought into contact with image-supporting substrate 11, whereby toner image T is fixed to mage-supporting substrate 11, as shown in FIGS. 2(*a*) to 2(*c*).

The same benefit can be obtained as the first embodiment of die image forming method by this image forming method.

In the image forming method practiced by the second embodiment, employing an adequate intermediate transfer material in place of surface protecting layer 13, and an image fixing sheet provided with toner-holding layer 15 on the intermediate transfer material, image fixing sheet is superposed on image-supporting substrate 11 while toner image T is held in toner-holding layer 15, thereafter, intermediate transfer material is peeled off, whereby toner image T may be fixed to mage-supporting substrate 11.

The Third Embodiment

Figure 3A:
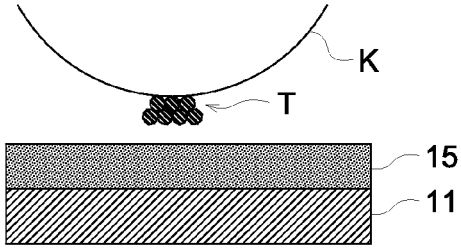
FIGS. 3*a* and 3*b* are schematic view for explaining the third embodiment of an image forming method relating to the invention, and, FIG. 3*a* illustrates a state that a toner image is formed on a photoreceptor.
Figure 3B:
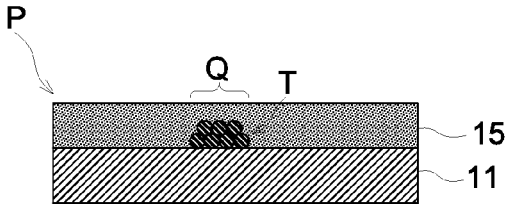

The second embodiment practicing the image forming method of the invention is a method same as the first embodiment excepted that, toner image T is embedded in toner-holding layer 15 laminated on image-supporting substrate 11 by external force so that toner particles are held, whereby toner image T is fixed to mage-supporting substrate 11, as shown in FIGS. 3(*a*), and 3(*b*).

Figure 4:
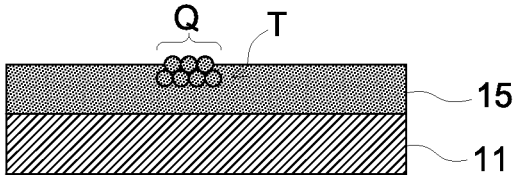
FIG. 4 illustrates a schematic view showing an example of an embodiment of the image print of the invention.

It is preferable that 50% by volume or more of whole toner particles composing toner image T are embedded in toner image T fixed on toner-holding layer 15, as shown in FIG. 4, particularly preferably, 100% by volume of whole toner particles are embedded as shown in FIG. 3 (*b*).

The same benefit can be obtained as the first embodiment of the image forming method by this image forming method.

Embodiments of the invention are described above, to which the embodiment are not restricted.

Example

The practical examples of the invention are described below.

Synthesis Example of Toner Particles

A hundred pairs by mass of polyester resin (Tg=61° C., Mn=4,200, Mw/Mn=5.5), 8 parts by mass of carbon black, 1 part by mass of charge control agent BONTRON E-81 (produced by Orient Chemical Industries, Ltd.), 90 parts by mass of magnetite were processed by a melt kneading machine and kneaded product was obtained. The product was processed by pulverized and classified and Toner (1) composed of toner particles (1) having a volume average particle diameter of 7.3 μm and an average circularity of 0.77.

The volume average particle diameter was measured by COULTER MULTISIZER (produced by Beckman Coulter Inc.), and the average circularity of toner particles was measured by a flow type particle image analyzing apparatus FPIA-2000 (produced by Sysmex Corp.).

Preparation Example of Developer

Two-component developer, Developer (1) was prepared by blending Toner (1) with silicone acryl coated carrier in a mass ratio of 6/94.

Toner-Holding Layer Forming Example 1

Ion exchanged water was added to 20% by mass of acrylamide, [005% by mass of N,N-methylene bis acrylamide, 5% by mass of sodium chloride, 3% by mass of polyvinyl alcohol having polymerization degree of 1,800 and saponification degree of 88% and 47% by mass glycerin so as to be 100% by mass, and coating composition was prepared by adding 0.3% by mass of 1-hydroxy-cyclohexylphenyl ketone. The coating composition was applied on to transparent PET film (A) (a surface protecting layer) having a thickness of 25 μm, and Precursor layer (1) of a toner-holding layer having a thickness of 100 μm was formed by irradiating UV ray. The Precursor layer (1) of a toner-holding layer was subjected to adjusting water content of 40% by mass by keeping standing in an environment of temperature at 25° C. and humidity of 90%, whereby a toner-holding layer (1) was obtained, and Image fixing sheet (1) was obtained.

When Toner-holding layer (1) of Image fixing sheet (1) was kept standing in an environment of temperature at 35° C. and humidity of 30% so as to reduce water content by 10% by mass from the state at the initial stage, a factor of shrinkage of said toner-holding layer (1) was 4% by volume with respect to the initial stage.

Toner-Holding Layer Forming Example 2

The Precursor layer (1) of a toner-holding layer was subjected to adjusting water content of 95% by mass by keeping standing in an environment of temperature at 35° C. and humidity of 90%, whereby a toner-holding layer (2) was obtained, and Image fixing sheet (2) was obtained.

When Toner-holding layer (2) of Image fixing sheet (1) was kept standing in an environment of temperature at 35° C. and humidity of 30% so as to reduce water intent by 10% by mass from the state at the initial stage, a factor of shrinkage of said toner-holding layer (1) was 7% by volume with respect to the initial stage.

Toner-Holding Layer Forming Example 3

The Precursor layer (1) of a toner-holding layer was subjected to adjusting water content of 5% by mass by keeping standing in an environment of temperature at 15° C. and humidity of 10%, whereby a toner-holding layer (3) was obtained, and Image fixing sheet (3) was obtained.

Example 1, Comparative Examples 1 and 2: Producing Examples of Image Prints 1 Though 3 at Initial Stage A toner image of "The imaging society of Japan Test Chart No. 3 1986R" formed by bizhub C 253 (Produced by Konica Minolta Business Technologies, Inc.) from which a fixing device is removed, using developer (1) was transferred on white PET sheet (B) (an image-supporting substrate). The above described image fixing sheets (1) through (3) were superposed in a state that a toner-holding layer was made contact with the toner image, and then they were allowed to pass through the removed fixing device without heating whereby they were pressed. Thus image prints (1) through (3) having white PET sheet (B) laminated with an image fixing sheet holding the toner image were obtained.

Evaluation of Image Precision

Fine line pattern R-3 in "The imaging society of Japan Test Chart No. 3 1986R" were observed with a magnifier of 10 time magnification factor as for obtained image print (1) through (3) and evaluated. The result is summarized in Table 1. Images having
5 lp (line pairs)/mm or more are judged to be acceptable.

Evaluation of Image Strength

Flannel cloth was pressed on an image portion of obtained image prints (1) through (3) with a pressure of 1 kPa and was allowed to slide forth and back 3.5 times, then the flannel cloth was took off. Image changes from the initial stage was tested by visual observation of 20 monitor persons, and a sample on which 18 or more monitors observed no image change was evaluated as acceptable (Good), and the other not acceptable (No good). The result is summarized in the Table.

TABLE 1

| | Image print No. | Hydrogel Water content (**) | Hydrogel Factor of shrinkage (**) | Image precision (lp)/mm | Image strength |
|---|---|---|---|---|---|
| Example 1 | 1 | 40 | 4 | 10 | Good |
| Comparative 1 | 2 | 95 | 7 | 2 | Good |
| Comparative 2 | 3 | 5 | — | 5 | No good |

(*) Water content by mass (**) Factor of shrinkage due to 10% water content reduction by mass in volume %.

Producing Examples of Reuse Image Print

Image fixing sheet (1) holding the toner image was peeled horn white PET sheet (B) of above described an image print (1), and was immersed into aqueous solution of 0.01 wt % SDS to swell the toner-holding layer, then magnetic force was applied while applying ultrasonic wave and toner particles were collected and removed. The removed toner was immersed in water and dispersed, and ultrasonic wave was applied to. Toner particles were recovered by repeating filtration and drying. Recovery rate of toner particles from image print (1) was 98% by mass. Developer for reuse (1-2) was obtained by blending the recovered toner particles as toner particles for reuse (1-2) with carrier. On the other side, image fixing sheet (1) was separated from SDS aqueous solution, and water content was adjusted to 40% by mass by standing in an environment of temperature at 25° C., and humidity of 90%, and thus image fixing sheet for reuse (1-2) was obtained.

Separated white PET sheet (B) by peeling was made as white PET sheet for reuse (B-2).

Reuse image print (1-2) was obtained in the similar manner as image print (1) of Example 1 according to the invention by employing developer for reuse (1-2), white PET sheet for reuse (B-2) and image fixing sheet for reuse (1-2). The obtained reuse image print (1-2) was not different in image quality by eye observation from image print (1) of an initial stage.

11: an image-supporting substrate
12: an image fixing sheet
13: a surface protecting layer
15: a toner-holding layer
K: a photoreceptor
P: an image print
Q: an image portion
T: a toner image

The invention claimed is:

1. An image forming method to form an image print comprising the steps of;

allowing an image-supporting substrate to carry a toner image formed by toner particles on its surface, and superposing a toner-holding layer on the image-supporting substrate carrying the toner image so that the toner-holding layer holds the toner image, whereby an image print is formed, wherein the toner-holding layer is composed of a hydrogel having a water content 10% by mass or more and not more than 90% by mass.

2. An image forming method to form an image print comprising the steps of;

allowing a toner-holding layer to hold a toner image fanned by toner particles, and superposing an image-supporting substrate on the toner-holding layer holding the toner image, whereby an image print is formed, wherein the toner-holding layer is composed of a hydrogel having a water content 10% to 90% by mass.

3. An image forming method to form an image print comprising a step of forming a toner image on an image carrier, and superposing a toner-holding layer provided on an image-supporting substrate on the image carrier carrying the toner image so that the toner image is held by the toner-holding layer, wherein the toner-holding layer is composed of a hydrogel having water content 10% to 90% by mass.

4. The image forming method to form an image print using toner particles separated from another image print formed by the image forming method of claim 1.

5. The image forming method to form an image print using an image-supporting substrate separated from another image print formed by the image forming method of claim 1.

6. An image forming method comprising steps of;

allowing an image-supporting substrate to carry a toner image formed by toner particles, and superposing a toner-holding layer composed of a hydrogel having a water content 10% to 90% by mass so that the toner-holding layer holds the toner image, wherein at least one of the toner particles, the toner-holding layer and the image-supporting substrate for forming the toner image has been separated from an image print formed by the image forming method of claim 1.

7. An image forming method comprising steps of;

allowing a toner-holding layer composed of a hydrogel having water content 10% to 90% by mass to hold a toner image formed by toner particles, and superposing the toner-holding layer holding the toner image on an image-supporting substrate, wherein at least one of the toner particles, the toner-holding layer and the image-supporting substrate for forming the toner image has been separated from an image print formed by the image forming method of claim 1.

8. The image forming method of the invention comprises steps of;

superposing a toner-holding layer composed of a hydrogel having water content 10% to 90% by mass on an image-supporting substrate, and allowing the toner-holding layer superposed on the image-supporting substrate to hold a toner image formed by toner particles, wherein at least one of the toner particles, the toner-holding layer and the image-supporting substrate for forming the toner image has been separated from an image print formed by the image forming method of claim 1.

* * * * *